US012371841B2

(12) United States Patent
Ayers et al.

(10) Patent No.: US 12,371,841 B2
(45) Date of Patent: Jul. 29, 2025

(54) DISPENSER CUP

(71) Applicant: WHIRLPOOL CORPORATION, Benton Harbor, MI (US)

(72) Inventors: Kevin Ayers, Saint Joseph, MI (US); Seth Bixby, Stevensville, MI (US); Sayer J. Murphy, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 450 days.

(21) Appl. No.: 17/961,829

(22) Filed: Oct. 7, 2022

(65) Prior Publication Data

US 2023/0030541 A1 Feb. 2, 2023

Related U.S. Application Data

(60) Division of application No. 16/504,482, filed on Jul. 8, 2019, now Pat. No. 11,492,746, which is a division of application No. 15/793,345, filed on Oct. 25, 2017, now Pat. No. 10,392,739, which is a continuation of application No. 15/253,128, filed on Aug. 31, 2016, now Pat. No. 9,863,082.

(51) Int. Cl.

| | |
|---|---|
| ***D06F 23/04*** | (2006.01) |
| ***D06F 39/02*** | (2006.01) |
| ***D06F 39/12*** | (2006.01) |

(52) U.S. Cl.

CPC ..... *D06F 39/022* (2013.01); *D06F 23/04* (2013.01); *D06F 39/12* (2013.01)

(58) Field of Classification Search

None

See application file for complete search history.

(56) References Cited

U.S. PATENT DOCUMENTS

| | | | |
|---|---|---|---|
| 6,401,499 | B1 | 6/2002 | Clark et al. |
| 2013/0327101 | A1 | 12/2013 | Leibman et al. |

*Primary Examiner* — Levon J Shahinian

(74) *Attorney, Agent, or Firm* — McGarry Bair PC

(57) ABSTRACT

A method of supplying treating chemistry to at least a treating chamber or at least one bulk reservoir of a laundry treating appliance. The method including selectively moving a selector compartment defining a selector compartment cup between a first position, where the selector compartment cup is fluidly coupled with the treating chamber and a second position where the selector compartment cup is fluidly coupled with the at least one bulk reservoir.

20 Claims, 4 Drawing Sheets

DISPENSER CUP

CROSS-REFERENCE TO RELATED APPLICATIONS

This application is a divisional application of U.S. patent application Ser. No. 16/504,482, filed Jul. 8, 2019, now U.S. Pat. No. 11,492,746, issued Nov. 8, 2022, which is a divisional of U.S. patent application Ser. No. 15/793,345, filed Oct. 25, 2017, now U.S. Pat. No. 10,392,739, issued Aug. 27, 2019, which is a continuation of U.S. patent application Ser. No. 15/253,128, filed Aug. 31, 2016, now U.S. Pat. No. 9,863,082, issued Jan. 9, 2018, all of which are incorporated herein by reference in their entirety.

BACKGROUND

Laundry treating appliances, such as clothes washers, clothes dryers, refreshers, and non-aqueous systems, can have a configuration based on a rotating drum that defines a treating chamber having an access opening through which laundry items are placed in the treating chamber for treating. The laundry treating appliance can have a controller that implements a number of pre-programmed cycles of operation having one or more operating parameters.

In some laundry treating appliances, the dispenser is in the form of a cup mounted on the surface of the cabinet. Such dispensers typically have at least one cup that defines a pour zone for a specific treating chemistry or dispensing functions such as a single use or bulk dispenser. It will be desirable for a washing machine to use minimal surface space as pour zones for various types of treating chemistry and dispensing functions.

BRIEF SUMMARY

In one aspect the disclosure relates to a method of supplying treating chemistry to at least a treating chamber or at least one bulk reservoir of a laundry treating appliance, the method comprising: selectively moving a selector compartment defining a selector compartment cup between a first position, where the selector compartment cup is fluid coupled with the treating chamber and a second position where the selector compartment cup is fluid coupled with the at least one bulk reservoir, whereby depending on the position of the selector compartment cup liquid treating chemistry in the selector compartment cup will flow into the treating chamber or the bulk reservoir.

In another aspect the disclosure relates to a method of supplying treating chemistry to multiple destinations in a laundry treating appliance, the method comprising selectively moving a selector compartment to fluidly couple an outlet of the selector compartment to one of multiple conduits, each of the multiple conduits supplying a different destination, with one of the destinations being a treating chamber and another of the destinations being a bulk reservoir.

DETAILED DESCRIPTION

Figure 1:
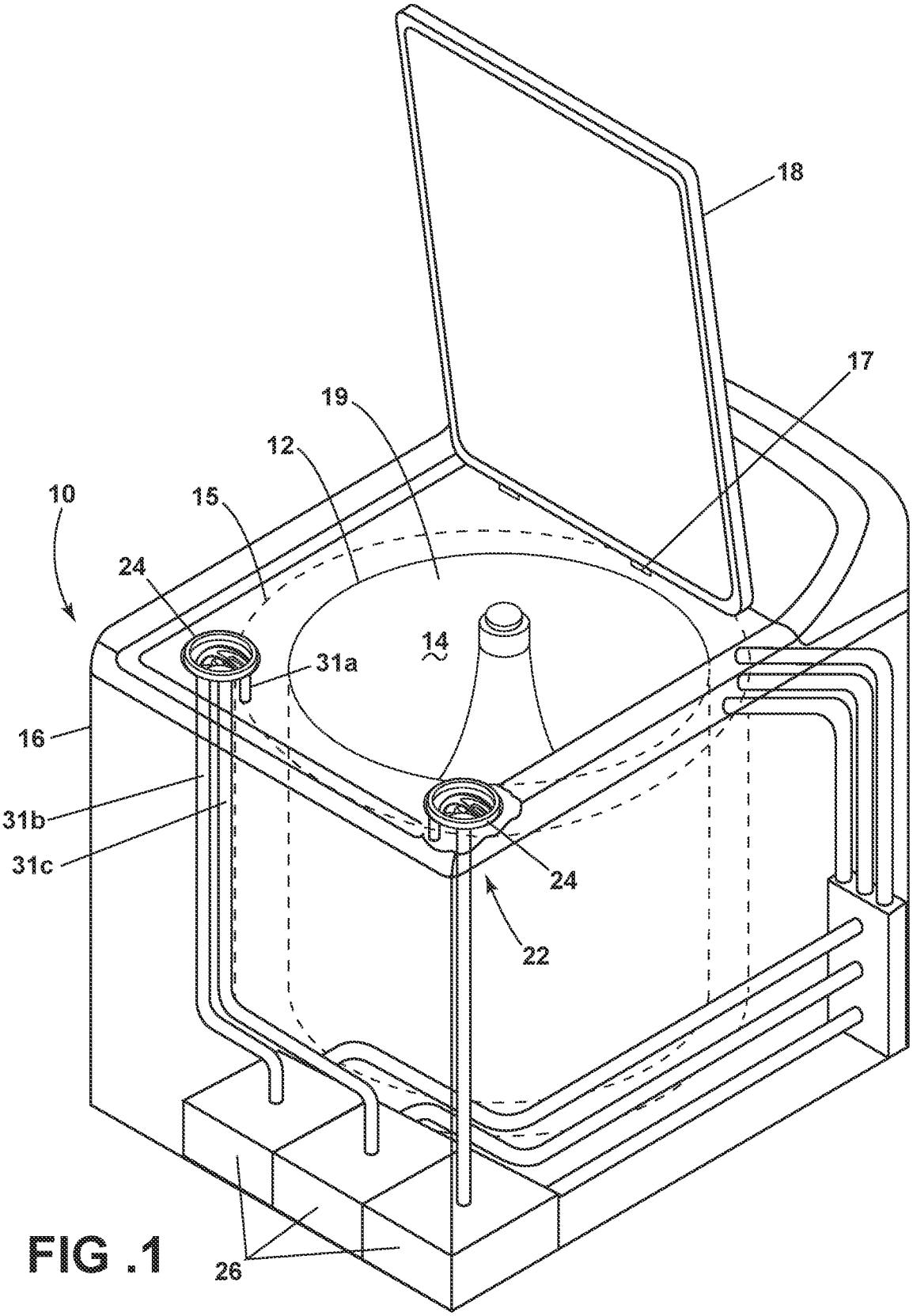
FIG. 1 is a front view of a laundry treating appliance in the form of an automatic washing machine having a cabinet with a door shown in an opened condition, and with a dispenser assembly.

Referring now to FIG. 1, a first embodiment in accordance with the present disclosure is illustrated as a laundry treating appliance in the environment of a vertical axis automatic clothes washing machine 10. Although much of the remainder of this application will focus on the embodiment of an automatic clothes washing machine, the illustrative embodiments have utility in other environments, including other laundry treating appliances or other top loading appliances with a single use or bulk dispenser. Depending on the configuration, it is possible for the embodiments to have applicability in horizontal axis washing machines and other front loading appliance.

The washing machine 10 shares many features of a conventional automated clothes washer, which will not be described in detail herein except as necessary for a complete understanding of the illustrative embodiments in accordance with the present disclosure. The washing machine 10 has a rotatable drum 12 that defines a treating chamber 14 for receiving the laundry and rotates about a generally vertical axis.

A tub 15 receives the drum 12 and holds liquid for use in a treating cycle of operation. The tub 15 can rotatably mount the drum 12. The tub 15 can be associated with a sump for holding a liquid used during a cleaning cycle. The sump can be normally connected to a drain (not shown) to provide a flow path for removing the liquids.

A cabinet 16 can define a housing within which a suspension system (not shown) is provided for suspending the tub 15 within the cabinet 16. The cabinet 16 can be a housing having a chassis and/or a frame to which panels are mounted to define an interior, enclosing components typically found in a conventional washing machine, such as motors, pumps, fluid lines, controls, sensors, transducers, and the like. Such components will not be described further herein except as necessary for a complete understanding of the disclosure.

A closure in the form of a door 18 is mounted to the cabinet 16 via a hinge 17. The door 18 can be rotated about the hinge 17 to selectively close an opening 19 to the treating chamber 14. Both the tub 15 and a drum 12 can be located within the interior of the cabinet 16.

The washing machine 10 can also be provided with a dispenser assembly 22 for dispensing treating chemistry to the treating chamber 14 for use in treating the laundry according to a cycle of operation. The dispenser assembly 22 is illustrated to include an integrated single use and bulk dispensing system.

The dispenser assembly 22 includes at least one treating chemistry fill cup assembly 24 and at least one bulk reservoir 26. The fill cup assembly 24 is mounted to the cabinet 16 in one of the corners of the surface surrounding the access opening 19 to the treating chamber 14. The fill cup assembly 24 can be rotated to selectively direct treating chemistry into the treating chamber 14 for a single use application or storage in the associated bulk reservoir 26 for bulk dispensing application. As shown in the illustration, the fill cup assembly 24 can be configured to direct treating chemistry to more than two destinations. For instance, fluid can be directed to the treating chamber 14 via fluid conduit 31*a* and to multiple bulk reservoirs 26 via fluid conduit 31*b* and 31*c*. These reservoirs 26 are used for containing various treating chemistries, such as but not limited to liquid detergent, bleach, and fabric softener. These reservoirs 26 can be located interiorly or exteriorly of the cabinet 16.

Figure 2:
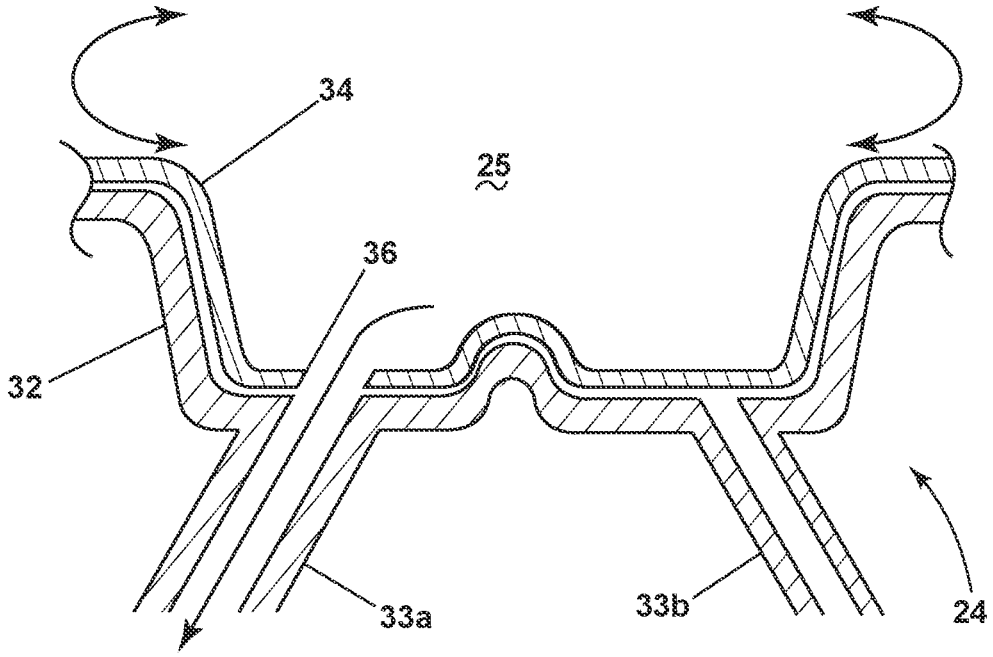
FIG. 2 is a schematic view of a treating chemistry fill cup assembly.

Referring to the schematic diagram of FIG. 2, the fill cup assembly 24 comprises a base cup 32 with at least first and second fluid conduits 33*a,b* supplying corresponding destinations, and a selector cup 34 defining a pour zone 25. The selector cup 34 includes an outlet 36 and rotatable relative to the base cup 32 to selectively fluidly couple the outlet 36 to the at least first and second fluid conduits 33*a,b*. As shown in the figure, the first fluid conduit 33*a* can be directed to the associated first destination and the second fluid conduit 33*b* can be directed to the second destination. By aligning the outlet 36 of the selector cup 34 to the fluid conduit 33*a* of the base cup 32, a single passage for the flow of fluid through fluid conduit 33*a* is created while passage to fluid conduit 33*b* is closed. Treating chemistry poured into the selector cup 34 can be directed exclusively to the first destination. Alternatively, the selector cup 34 can be rotated clockwise or anti-clockwise to selectively align the outlet 36 to create a passage for fluid to flow through the fluid conduit 33*b* into the second destination.

Figure 3:
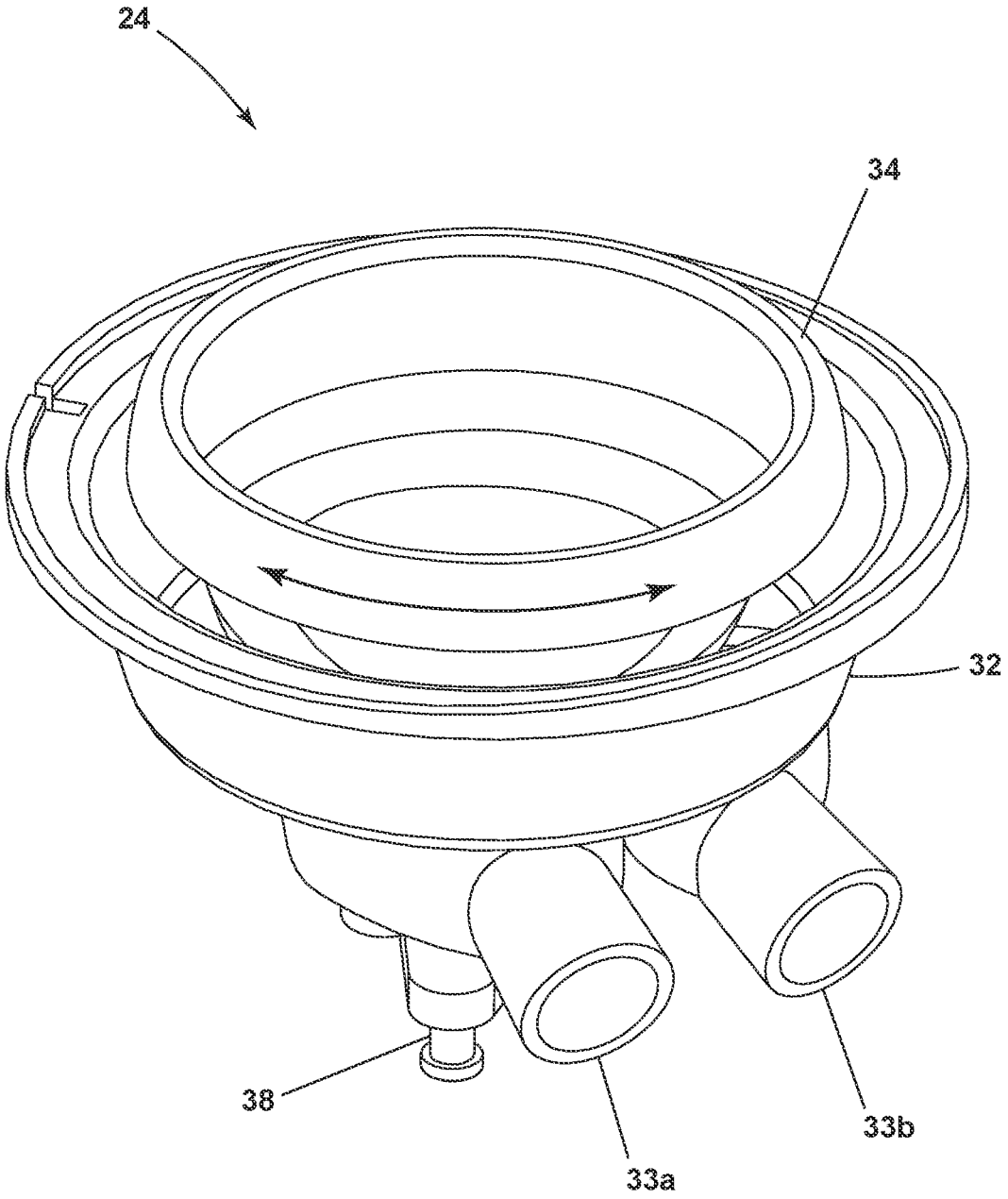
FIG. 3 is a perspective view of the treating chemistry fill cup assembly.
Figure 4:
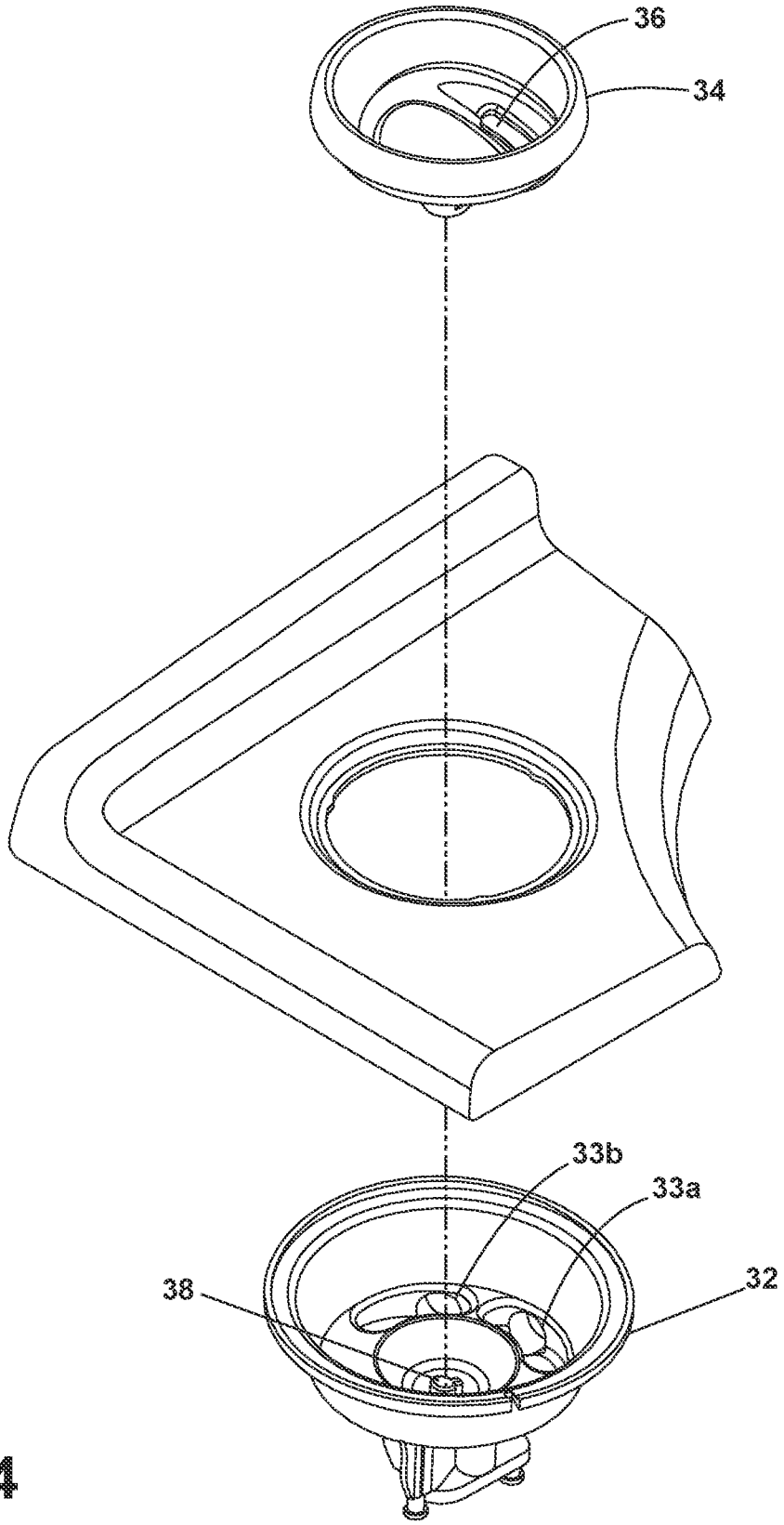
FIG. 4 is an exploded, perspective view of the treating chemistry fill cup assembly of FIG. 3.

Referring to FIGS. 3 and 4, the selector cup 34 and base cup 32 have complementary shapes wherein the selector cup 34 is at least partially received within the base cup 32. A rotatable shaft 38 with over-the-center spring mechanism passes through the base cup 32 and is rotatable by the selector cup 34. The rotatable shaft 38 with over-the-center spring mechanism biases the base cup 32 and selector cup 34 towards one another and act as a detent mechanism between the base cup 32 and selector cup 34 to divide the rotation into specific increments. As shown in FIG. 4, the specific increments can be configured to align the outlet 36 of the selector cup 34 to each fluid conduits 33*a,b* of the base cup 32. The specific increments can also be configured to align the outlet 36 to a sealed region of the base cup 32 to create a closing position without having a separate lid.

The fill cup assembly 24 utilizes a single pour zone 25 to direct treating chemistries to multiple destinations. This feature improves the ease of use and maintains aesthetic value with a clean surface finish surrounding the access opening 19 to the treating chamber 14. Furthermore, it will not be necessary to decrease the size of the access opening 19 of the treating chamber 14 due to having multiple pour zones for various chemistries and dispensing function.

Although the embodiment of the present invention have been shown and described, it would be appreciated by those skilled in the art that changes may be made in these embodiments without departing from the principles and spirit of the invention, the scope of which is defined in the claims and their equivalents.

The invention claimed is:

1. A method of supplying treating chemistry to at least a treating chamber or at least one bulk reservoir of a laundry treating appliance, the method comprising: selectively moving a selector compartment defining a selector compartment cup between a first position, where the selector compartment cup is fluidly coupled with the treating chamber and a second position where the selector compartment cup is fluidly coupled with the at least one bulk reservoir, whereby depending on the position of the selector compartment cup, a liquid treating chemistry in the selector compartment cup will flow into the treating chamber or the bulk reservoir.

2. The method of claim 1 wherein selectively moving the selector compartment cup comprises moving the selector compartment cup relative to a base cup holding the selector compartment cup.

3. The method of claim 2 wherein moving the selector compartment cup comprises rotating the selector compartment cup relative to the base cup.

4. The method of claim 3 wherein rotating the selector compartment cup relative to the base cup comprises rotating the cup to different detent positions corresponding to the first positions and the second position.

5. The method of claim 1 wherein the at least one bulk reservoir comprises multiple bulk reservoirs which are fluidly coupled to the selector compartment cup at different physical positions of the selector compartment cup.

6. The method of claim 5 wherein the laundry treating appliance includes a cabinet defining an interior and having an access opening providing access to the interior and a treating chamber located within the interior; wherein the multiple bulk reservoirs are located interiorly or exteriorly of the cabinet.

7. The method of claim 1 wherein the selector compartment cup is located in a front portion of the laundry treating appliance.

8. The method of claim 7 wherein the selector compartment cup is located above the at least one bulk reservoir.

9. The method of claim 1 wherein the selector compartment cup is nested in a base cup and moves relative to the base cup.

10. The method of claim 9 wherein fluid conduits selectively couple the base cup to the treating chamber and the bulk reservoir.

11. The method of claim 10 wherein the base cup comprises a first fluid outlet coupled to the treating chamber by a first fluid conduit and a second fluid outlet coupled to the bulk reservoir by a second fluid conduit.

12. The method of claim 11 further comprising closing one of the first or second fluid outlets in the base cup and opening the other of the first or second outlets in the base cup by rotating the selector compartment cup.

13. The method of claim 12 wherein the selector compartment cup comprises a single outlet and the base cup comprises two outlets.

14. The method of claim 9 wherein the selector compartment cup and the base cup have complimentary shapes.

15. A method of supplying treating chemistry to multiple destinations in a laundry treating appliance, the method comprising selectively moving a selector compartment to fluidly couple an outlet of the selector compartment to one of multiple conduits, each of the multiple conduits supplying a different destination, with one of the destinations being a treating chamber and another of the destinations being a bulk reservoir.

16. The method of claim 15 wherein the selector compartment comprises a selector cup.

17. The method of claim 16 comprising a base cup that is configured to receive the selector cup therein, the method comprising moving the selector cup relative to the base cup to fluidly couple the selector compartment with each of the multiple conduits.

18. The method of claim 15 wherein selectively moving the selector compartment comprises rotating a cup relative to a cup base.

19. The method of claim 18 wherein rotating the cup relative to the cup base comprises rotating the cup between different detent positions.

20. The method of claim 19 wherein each detent position corresponds to a different fluid connection between the selector compartment and one of the multiple conduits.

* * * * *